United States Patent [19]

Dietz et al.

[11] 3,991,680

[45] Nov. 16, 1976

[54] TAGGING EXPLOSIVES WITH SULFUR HEXAFLUORIDE

[75] Inventors: Russell N. Dietz, Shoreham; Edgar A. Cote, Yaphank; William Vogel, East Islip, all of N.Y.; John C. Dempsey, Frederick, Md.

[73] Assignee: The United States of America as represented by the United States Energy Research and Development Administration, Washington, D.C.

[22] Filed: May 15, 1975

[21] Appl. No.: 577,822

[52] U.S. Cl. ..... 102/28 R; 149/2; 149/19.3

[51] Int. Cl.[2] ..... F42C 19/12

[58] Field of Search ..... 102/28 R, 27 R; 149/19.3, 2, 109.4; 250/282

[56] References Cited

UNITED STATES PATENTS

| | | | |
|---|---|---|---|
| 3,325,318 | 6/1967 | Pauliukonis | 149/1 X |
| 3,667,388 | 6/1972 | Heinemann | 102/28 R |
| 3,732,132 | 5/1973 | Merrow et al. | 149/19.3 |
| 3,765,334 | 10/1973 | Rentz et al. | 149/19.3 X |
| 3,783,788 | 1/1974 | Hayashi | 102/28 R |
| 3,835,782 | 9/1974 | Griffith et al. | 102/27 R |
| 3,920,987 | 11/1975 | Anbar et al. | 250/282 |

*Primary Examiner*—Edward A. Miller
*Attorney, Agent, or Firm*—Dean E. Carlson; Leonard Belkin

[57] ABSTRACT

Method and apparatus for tagging explosives with a source of $SF_6$ permitting the detection of their presence utilizing sensitive sniffing apparatus.

5 Claims, 2 Drawing Figures

TAGGING EXPLOSIVES WITH SULFUR HEXAFLUORIDE

The invention described herein was made in the course of, or under a contract with the United States Atomic Energy Commission and/or the United States Energy Research and Development Administration.

BACKGROUND OF THE INVENTION

There has been increasing interest in the development of techniques for the detection of explosive materials. Recent terrorist activities including that of attempts to cause the destruction of civil aircraft in flight, as well as efforts to detonate explosives in places where large groups of people congregate, have heightened this interest. In addition, there is interest in preventing theft of such explosive materials from manufacturing plants.

Present approaches to the detection of explosives involve the use of comprehensive physical searches, X-ray and similar equipment, and dogs trained to sniff out the presence of certain types of explosive materials.

These approaches are either unwieldy or are of limited usefulness.

SUMMARY OF THE PRESENT INVENTION

The present invention overcomes many of the disadvantages of the techniques now in use by providing a simplified yet reliable approach to the problem of the detection of explosive materials.

In accordance with a preferred embodiment of this invention there is provided a method of tagging an explosive comprising the step of enclosing within the blasting cap a source of $SF_6$ to release over a period of time the $SF_6$ in sufficient amounts of the latter to permit detection. In one embodiment, the source is a solid member fully saturated initially with the $SF_6$, and in another embodiment a capsule is inserted containing liquid $SF_6$ under pressure, the capsule being provided with a permeable window to permit a controlled release of the $SF_6$ gas over a longer period of time.

Because of the penetrating nature of $SF_6$, this invention makes it possible to detect the presence of tagged explosives inside of closed packages merely by employing a so-called sniffer to monitor these packages.

Other advantages and objects of this invention will hereinafter become evident from the following description of preferred embodiments of this invention.

DESCRIPTION OF THE PREFERRED EMBODIMENTS

Figure 1:
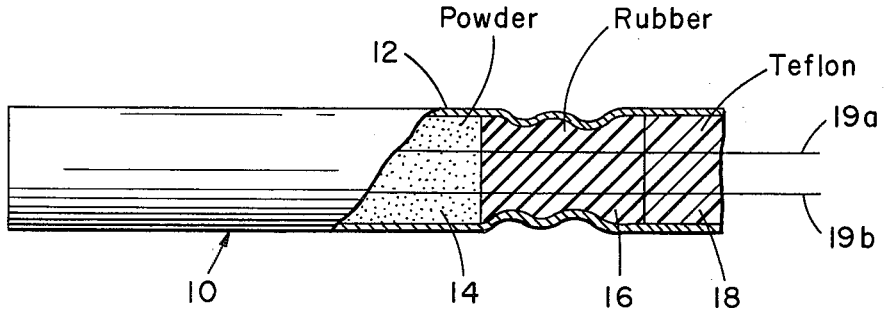
FIG. 1 is an elevation view in partial section of a preferred embodiment of this invention.

FIG. 1 shows a detonator or blasting cap 10 of conventional construction consisting of a shell 12 containing an explosive or detonating material 14. A rubber stopper 16 is crimped into place to seal the interior of shell 14. Within shell 12, but located on the other side of stopper 16 from the sealed material 14 is located a source 18 of the $SF_6$. A pair of electrical leads 19*a* and 19*b* enter cap 10 to permit electric initiation.

Source 18 is a disc of suitable material in which $SF_6$ is adsorbed. The material selected for source 18 is one which has the characteristics of adsorbing large amounts of $SF_6$ at elevated pressures and releasing the $SF_6$ at a slow rate at ambient conditions over a long period of time. Such materials are available commercially and include the various fluoropolymers sold commercially under various trademarks including Teflon, a trademark of the DuPont Company for tetrafluoroethylene propylene. Other such fluoropolymers known in the art include chlorotrifluoroethylene copolymer (CTFE), ethylene-chlorotrifluoroethylene copolymer (E-CTFE), perfluoroalkoxy copolymer (PFA), ethylene-tetrafluoroethylene (ETFE), and fluorinated ethylene propylene copolymer (FEP). Extensive studies and tests were conducted to establish the effectiveness of the methods and apparatus described herein.

EXAMPLES

Table I shows the results of loading several different materials with $SF_6$ by exposing a disc of each of the materials to $SF_6$ at 300 psig at the temperature and for the time period indicated in the table. All of the materials listed in Table I are fluoropolymers available commercially. The ability of these materials to retain the adsorbed $SF_6$ 330 days from loading is shown from measurements taken of three other samples of TFE appearing in Table II. Results are similar for all the other materials.

Studies were made to determine whether certain materials could be employed as effective barriers to the detection of the $SF_6$. It was found that if a moderately strong $SF_6$ source is employed it is reasonably certain that barrier materials which allowed the $SF_6$ concentration to reach 10% of steady state within 10 hours or less should not present any significant problem to detection. By a moderately strong $SF_6$ source is meant herein a source with an elution rate of at least 1 nanoliter per minute or greater. Table III shows the results of tests taken employing selected barrier materials. The nature of diffusion phenomena is such that it appears that there are few effective ways of preventing the permeation of $SF_6$ in amounts which are detectable.

To test the effectiveness of this method over a period of time, several TFE pieces impregnated with $SF_6$ were carefully measured for $SF_6$ weight loss using the electrobalance and by measuring the $SF_6$ concentration in dry air when passed over the pieces. Table VI lists the measured weight of remaining $SF_6$ as a function of the number of days since initial loading for three of these pieces. The measured $SF_6$ concentrations are also included.

The present invention depends for its effectiveness in part on the availability of apparatus to detect or "sniff" the presence of $SF_6$. There are available commercially apparatus which have this capability in sensitivity required herein. For example, there is the Analog Technology Corporation's Model 140 wide range electron-capture detector system. In addition the Brookhaven National Laboratory has developed a $SF_6$ Sniffer which is described completely in a paper "Tracing Atmospheric Pollutants by Gas Chromatographic Determination of Sulfur Hexafluoride" appearing in Environmental Science and Technology, Vol. 7, pp. 338–342, Apr. 1973. Other companies also have available apparatus which would be useful.

In the embodiment shown in FIG. 1, the rate at which the $SF_6$ is released declines with time.

Figure 2:
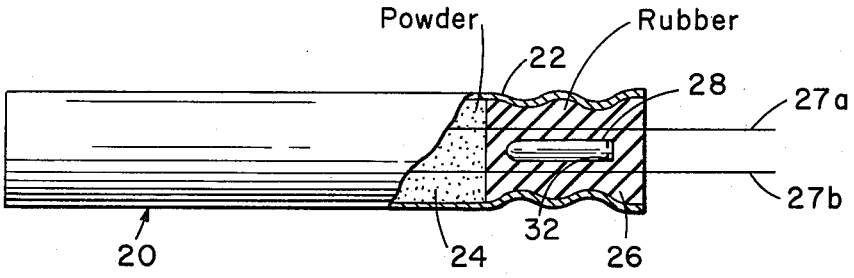
FIG. 2 is an elevation view in partial section of an alternative preferred embodiment of this invention.

In order to provide for a more uniform rate of release of the $SF_6$, the embodiment shown in FIG. 2 may be utilized. There is shown a detonator or blasting cap 20 consisting of a shell 22 containing explosive or detonating material 24. A rubber stopper 26 is crimped into place to seal the interior of shell 24. A pair of electrical leads 27*a* and 27*b* are provided for initiation.

Embedded within stopper 26 is $SF_6$ source 28 which consists of a sealed capsule of metal construction containing liquid $SF_6$ under pressure. A window 32 of permeable material such as rubber permits $SF_6$ to be released at a uniform, controlled rate over a longer period of time as compared to the embodiment shown in FIG. 1.

TABLE I

| Material | Material wt., g. | $SF_6$ Loading, mg per gram material 100° C Hours/21 | 64 | 25° C 18 | 117 | 166 |
|---|---|---|---|---|---|---|
| CTFE | 0.045 | 2.2 | 4.6 | 0.3 | 0.2 | 0.1 |
| E-CTFE | 0.040 | 1.7 | 5.5 | 0.2 | 0.2 | 0.1 |
| PFA | 0.018 | 16.8 | 12.9 | 65.0 | 62.8 | 65.9 |
| TFE-1 | 0.019 | 18.6 | 14.7 | 50.1 | 64.3 | 66.5 |
| ETFE | 0.010 | 10.1 | 9.6 | 1.2 | 4.7 | 5.3 |
| TFE-2 | 0.016 | 10.9 | 9.3 | 33.8 | 38.2 | 37.3 |
| FEP | 0.014 | 18.4 | 14.9 | 60.0 | 71.6 | 74.3 |

TABLE II

| TFE Piece No. | Weight of absorbed $SF_6$, mg/g Measured | Predicted Second Order | Third Order |
|---|---|---|---|
| 1 | 12.003 | 11.788 | 12.048 |
| 2 | 12.275 | 11.631 | 11.903 |
| 3 | 12.063 | 11.632 | 11.891 |

TABLE II-continued

| TFE Piece No. | Weight of absorbed $SF_6$, mg/g Measured | Predicted Second Order | Third Order |
|---|---|---|---|
| | average deviation: | −0.430 | −0.166 |

TABLE III

| Barrier Material | | Volume, in.³ | k %/hr | Time to 10%, hours | Barrier Capability |
|---|---|---|---|---|---|
| Cardboard carton | | 1 | — | <0.01 | ineffective |
| | | 112 | — | 0.07 | " |
| Polyethylene bottle | (6 dram) | 1.4 | 0.9 | 11.1 | moderate |
| | (1 qt.) | 58 | 0.85 | 11.8 | " |
| Paint can | (½ pint) | 14.4 | 4 | 2.5 | slight |
| | (1 gal.) | 231 | 0.70 | 14.3 | moderate |
| Glass jar | (1 ounce) | 1.8 | <0.0004 | (>3 years) | very severe |
| | (1 qt.) | 58 | 0.70 | 14.3 | moderate |
| Polyethylene zip-lock bag | | 1 | 31 | 0.32 | negligible |
| | | 50 | 0.52 | 19 | mod. to severe |
| Brass pipe | (¾ inch) | 1.5 | 0.0017 | 5900 | very severe |
| | (2 inch) | 23 | 0.37 | 27 | severe |

TABLE IV

| Teflon Piece No. | Time, days | Weight (W) of Absorbed $SF_6$, mg/g Meas. | Calculated 2nd order | 3rd order | $SF_6$ Concentration × $10^9$ Meas. | Calc. |
|---|---|---|---|---|---|---|
| 1 | 157 | 17.085 | 16.964 | 17.009 | | |
| | 171 | 16.321 | 16.382 | 16.364 | 1.065 | 0.721 |
| | 211 | 14.846 | 14.919 | 14.861 | 0.774 | 0.540 |
| | 238 | 13.995 | 14.071 | 14.053 | 0.512 | 0.456 |
| | 261 | 13.508 | 13.422 | 13.460 | | |
| | 269 | | | | 0.538 | 0.384 |
| | | S.D. | ±0.096 | ±0.058 | | |
| 2 | 157 | 17.108 | 16.967 | 17.036 | | |
| | 171 | 16.308 | 16.359 | 16.356 | 1.150 | 0.781 |
| | 196 | 15.306 | 15.376 | 15.322 | 0.838 | 0.642 |
| | 211 | 14.773 | 14.841 | 14.788 | 0.727 | 0.577 |
| | 238 | 13.974 | 13.967 | 13.953 | 0.539 | 0.485 |
| | 261 | 13.345 | 13.299 | 13.343 | | |
| | 269 | | | | 0.537 | 0.406 |
| | | S.D. | ±0.083 | ±0.041 | | |
| 3 | 157 | 16.859 | 16.826 | 16.900 | | |
| | 171 | 16.239 | 16.239 | 16.243 | 1.058 | 0.727 |
| | 185 | 15.711 | 15.692 | 15.657 | 0.860 | 0.651 |
| | 211 | 14.697 | 14.768 | 14.719 | 0.695 | 0.541 |
| | 238 | 13.905 | 13.916 | 13.903 | 0.443 | 0.456 |
| | 261 | 13.300 | 13.265 | 13.306 | | |
| | 269 | | | | 0.534 | 0.383 |
| | | S.D. | ±0.040 | ±0.031 | | |

What is claimed is:

1. An electrical detonator having a shell containing a detonating material and means for sealing said shell, the improvement comprising a source of $SF_6$ within said shell, said source releasing said $SF_6$ over a period of time.

2. The detonator of claim 1 in which said source is located adjacent to and on the outer side of said sealing means.

3. The detonator of claim 2 in which said source is a solid member impregnated with said $SF_6$.

4. The detonator of claim 3 in which said source is a fluoropolymer containing adsorbed $SF_6$.

5. The detonator of claim 2 in which said source is a sealed capsule containing liquid $SF_6$, said capsule having a permeable window to permit controlled release of $SF_6$ gas.

* * * * *